United States Patent [19]

Diebold

[11] 4,066,385

[45] Jan. 3, 1978

[54] A JET PUMP

[76] Inventor: Robert J. Diebold, 7113 36th Ave. N., St. Petersburg, Fla. 33710

[21] Appl. No.: 666,034

[22] Filed: Mar. 11, 1976

[51] Int. Cl.[2] ..... F04F 5/46

[52] U.S. Cl. ..... 417/172; 417/194

[58] Field of Search ..... 417/171, 172, 194, 197, 417/198

[56] References Cited

U.S. PATENT DOCUMENTS

| | | | |
|---|---|---|---|
| 47,174 | 4/1865 | Turrell et al. | 417/172 |
| 2,909,127 | 10/1959 | Bradaska | 417/172 |
| 3,134,338 | 5/1964 | Dodge | 417/194 |

*Primary Examiner*—Carlton R. Croyle
*Assistant Examiner*—Leonard E. Smith
*Attorney, Agent, or Firm*—Edward C. Threedy

[57] ABSTRACT

A jet pump for use in inline piping embodying a venturi tube and a deflection nozzle for creating a vacuum by reversing the flow of an inducing liquid through the venturi tube, the resulting suction of which causes a liquid flow through the venturi tube and piping system.

1 Claim, 3 Drawing Figures

A JET PUMP

SUMMARY OF THE INVENTION

A venturi type jet pump structure for creating a vacuum siphon effect in a liquid piping system. The structure includes a venturi having the normal restricted throat through which both the inducing and inducted liquids are made to pass. A nozzle for inducing liquid sits within a portion of the venturi and defines separate paths for the liquid as it is directed into the throat of the venturi. The nozzle provides an annular deflector flange that functions to reverse the flow of the inducing liquid so that it will under pressure freely flow through its designated path through the throat of the venturi, with the volume necessary to create a facuum within the venturi, establishing a siphon-like suction in the piping so as to induce the static liquid therein to flow through the jet pump.

A principal feature of the structure is the provision in the outer wall surface of the venturi of curved channels through which the inducing liquids flow until intercepted by the deflector flange. The swirling motion of the liquid creates a greater pressure in the pressure chamber located between the nozzle and the venturi throat, resulting in greater jetlike force of the liquid as it passes through the restricted throat of the venturi, thus creating a greater siphon-like action therein.

GENERAL DESCRIPTION

The objects of the invention are capable of being achieved by the structure illustrated in the accompanying drawings disclosing the preferred embodiment of the invention, and in which.

It is generally known that liquid flow may be induced in a piping system by creating a vacuum above the static head of the liquid in the piping system whereby the vacuum creates a suction which imparts liquid flow through the entire system.

It is also known that a venturi type tube is capable of creating a vacuum by reason of a directed and restricted flow of fluids in such tube.

The present invention relates to a jet pump which includes an improvement over the accepted structure of the venturi type tube.

Figure 1:
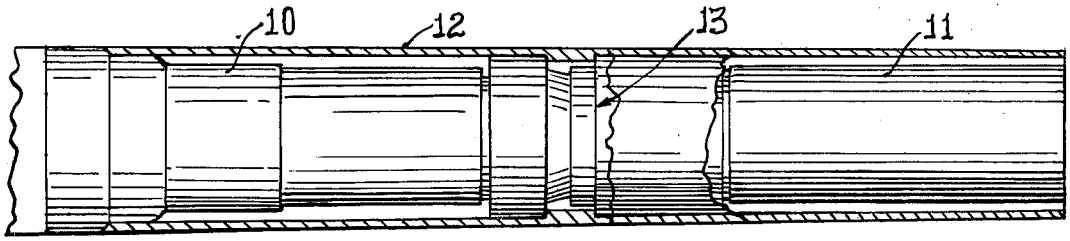
FIG. 1 is a fragmentary perspective view of the jet pump in a piping system.

As illustrated in FIG. 1, there is shown a venturi type jet pump structure which includes a pipe section 10 connectable to a pipe system in which there exists a static liquid head (not shown). The pipe section 10 is connected in axial alignment with a discharge tube 11. Connecting the section 10 and tube 11 together is a sleeve 12 which houses the component parts of the jet pump 13.

Figure 3:
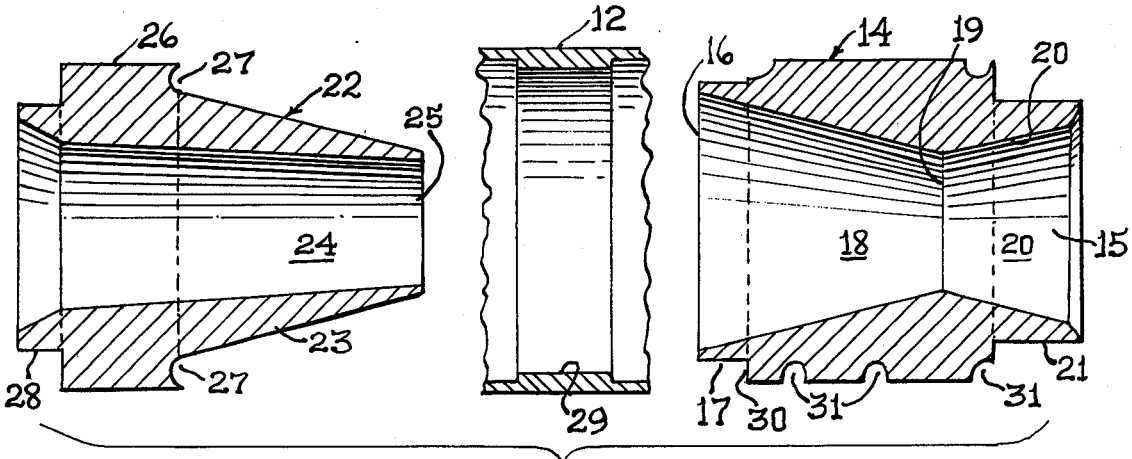
FIG. 3 is an enlarged detailed sectional view of the components of the jet pump in exploded relation one to another.

As shown in FIG. 3, the jet pump 13 consists of a venturi 14 having formed therethrough a flow passage 15. To one side 16 of the venturi 14 there is an annular flange 17 of a diameter less than that of the venturi 14. Extending through the flange 17 and the portion of the inner body of the venturi 14 is a frustoconical shaped bore 18, which, at a throat 19, joins a reversely extending frustoconical shaped bore 20 which extends through the remaining inner portion of the venturi 14 as well as an enlarged flange 21.

For the sake of clarification, the first described frustoconical shaped bore 18 will be termed the "induction chamber." Adapted to project into the induction chamber is a nozzle 22 which consists of a frustoconical shaped cone 23 having formed therethrough a bore 24 tapered in the direction of the induction chamber of the venturi 14.

The cone 23 provides an exhaust port 25 which is adapted to be placed in junction with the throat 19 of the venturi 14 when the nozzle 22 is inserted into the induction chamber. The nozzle 22 also provides an annular flange 26 which is of a diameter equal to the diameter of the venturi 14.

As shown in FIG. 3, the side wall of the flange 26 which is adapted to face the venturi 14, is formed to provide a recessed annular groove 27, the purpose and function of which will hereinafter be made apparent. The nozzle 22 also provides on its other end an annular flange 28 adapted to be projected into the pipe section 10.

In order to properly place the nozzle 22 into the venturi 14, the sleeve 12 provides an internal shoulder 29 which is adapted to engage the annular shoulder 30 formed between the body of the venturi 14 and the peripheral flange 17 as well as the side wall of the flange 26 of the nozzle 22 which is formed to contain the groove 27.

Figure 2:
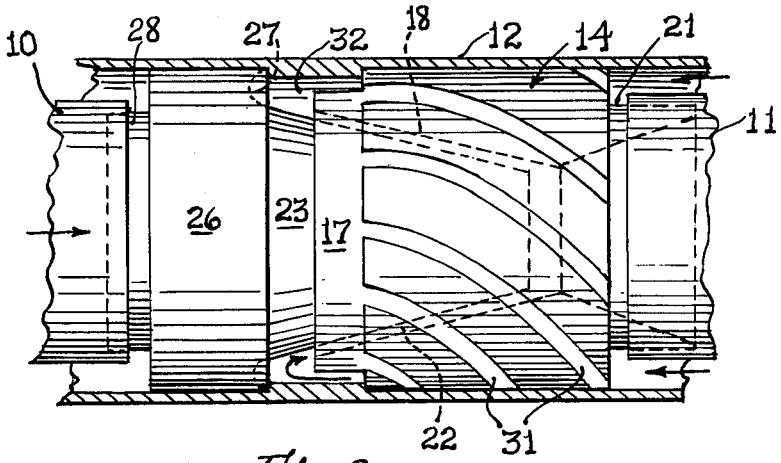
FIG. 2 is an enlarged fragmentary sectional detail view of the components of the jet pump of this invention.

The arrangement of the components of the jet pump is clearly shown in FIG. 2.

To achieve the desired function of the jet pump, it is important that the inducing fluid is caused to pass through the venturi 14 and beyond the throat 19 thereof with as great a pressure as can be created within the physical limits of the pipe system. In order to achieve greater pressure, it is desired to excite or activate the liquid. In order to achieve this, I have provided in the external annular wall of the venturi 14 a plurality of arcuate channels 31 which will cause the inducing liquid to pass over the venturi 14 with a swirling action into the pressure chamber 32 formed within the confines of the shoulder 29 of the sleeve 12 and between confronting portions of the nozzle 22 and venturi 14.

It must be remembered that the pipe section 10 contains therein a static head of a liquid. In operation an inducing liquid is introduced between the pipe section 11 and the sleeve 12 as shown by the arrows in FIG. 2. This liquid will pass through the channels 31 into the pressure chamber 32 in a swirling action whereby to impinge upon the annular grove 27 and be deflected back over the outer wall surface of the cone 23 of the nozzle 22 beneath the wall 18 of the bore formed in the venturi 14 beyond the exhaust port 25 and through the restricted throat 19 into the enlarging flow passage 15 of the venturi 14.

The inducing liquid passes over the nozzle 22 and through the throat 19 of the venturi 14 with sufficient jet force as to create a vacuum within the center bore of the nozzle 22 and the pipe section 10 such that there is a resulting siphon suction created upon the static liquid head within the pipe secton 10, causing a liquid flow therethrough and into the discharge tube 11.

The agitated liquid within the pressure chamber 32 as a result of the forced swirling action of the inducing liquid over the outer surface of the venturi 14, results in a greater jet pressure of such liquid over the nozzle 22 and through the throat of the venturi 19 than is normally achieved by conventional means, with the result that there is a greater and faster induced flow of liquid therethrough.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

I claim:

1. A jet pump for use in a piping system having a static liquid head comprising a. a one-piece elongated sleeve adapted to be connected into the piping system and providing intermediate its ends an internal shoulder, b. a discharge tube carried within said sleeve and having a diameter less than said sleeve to form a fluid passage therebetween, c. a venturi within said sleeve and connected at one end to said discharge tube and blocking said passage between said sleeve and said tube, d. said venturi providing adjacent its opposite end an annular shoulder bearing against one side of said internal shoulder within said sleeve, e. a restricted throat formed internally of said venturi by first converging and then diverging frustoconically shaped bores, f. a nozzle within said sleeve and providing a cone-shaped exhaust positioned within and in spaced relation to said converging frustoconically shaped bore of said venturi and terminating adjacent one side of said restricted throat, g. said nozzle providing an annular flange bearing against the opposite side of said internal shoulder within said sleeve so as to space said nozzle from said venturi, h. a fluid pressure chamber formed beneath said internal shoulder and between confronting portions of said venturi and said nozzle, i. a plurality of curved channels formed throughout the periphery of said venturi extending uniformly from said fluid passage to said fluid pressure chamber so as to provide restricted communication therebetween, and j. a radially extending deflector flange provided by said nozzle adjacent to its bearing contact with said internal shoulder of said sleeve and having an annular groove facing said fluid pressure chamber to reverse the direction of flow of the fluid from said channels over said cone-shaped exhaust of said nozzle and into said venturi and through said restricted throat with sufficient pressure to create a vacuum in said discharge tube.

* * * * *